US006054021A

United States Patent [19]

Kurrle et al.

[11] Patent Number: 6,054,021

[45] Date of Patent: Apr. 25, 2000

[54] PROCESS OF MANUFACTURING AUTHENTICATABLE PAPER PRODUCTS

[75] Inventors: Frederick L. Kurrle, Laurel; Christopher J. Parks, Ellicott City, both of Md.

[73] Assignee: Westvaco Corporation, New York, N.Y.

[21] Appl. No.: 09/233,437

[22] Filed: Jan. 20, 1999

[51] Int. Cl.[7] ..... D21H 21/48; D21H 21/40; D21H 19/40; B42D 15/10

[52] U.S. Cl. ..... 162/140; 162/134; 162/184; 162/185; 162/162; 162/158; 162/137; 162/198; 162/49; 162/135; 162/181.8; 283/89; 283/92; 428/916; 428/207

[58] Field of Search ..... 162/140, 134, 162/135, 137, 162, 158, 198, 183, 181.1, 181.8, 184, 185; 283/49, 72, 89, 92; 428/206, 207, 195, 211, 916

[56] References Cited

U.S. PATENT DOCUMENTS

| | | | |
|---|---|---|---|
| 34,634 | 3/1862 | Hayward | 162/140 |
| 210,497 | 12/1878 | Casilear | 162/140 |
| 282,106 | 7/1883 | Musil | 162/140 |
| 322,130 | 7/1885 | Schreiber | 162/140 X |
| 322,131 | 7/1885 | Schreiber | 162/140 X |
| 1,938,543 | 12/1933 | Sanburn . | |
| 2,089,293 | 8/1937 | Paine et al. | 162/140 |
| 2,208,653 | 7/1940 | Whitehead . | |
| 2,379,443 | 7/1945 | Kantrowitz et al. . | |
| 4,120,445 | 10/1978 | Carrier et al. | 229/53 |
| 4,273,362 | 6/1981 | Carrier et al. | 283/95 |
| 4,863,783 | 9/1989 | Milton | 428/207 |
| 5,026,507 | 6/1991 | Gowan, Jr. et al. | 252/301 |
| 5,141,672 | 8/1992 | Gowan, Jr. | 252/301 |
| 5,565,276 | 10/1996 | Murakami et al. | 428/537.5 |
| 5,759,349 | 6/1998 | Foster et al. | 162/158 |

FOREIGN PATENT DOCUMENTS

| | | |
|---|---|---|
| 2 478 695 | 9/1981 | France . |
| 442530 | 2/1936 | United Kingdom . |

OTHER PUBLICATIONS

Sakar in "Fluorescent Whitening Agents," Merrow Publishing Co. Ltd, pp. 12–50, Jan. 1971.

Crouse et al., "Fluorescent Whitening Agents in the Paper Industry," Tappi, vol. 64, No. 7, pp. 87–89, Jul. 1981.

*Primary Examiner*—Stanley S. Silverman
*Assistant Examiner*—Jose A. Fortuna

[57] ABSTRACT

An authenticatable paper product is prepared by adding to a papermaking furnish fibers treated with from about 50–200 lb/ton of a fluorescent whitening agent (FWA). The paper made from the papermaking furnish will include fluorescent cellulosic fibers in an amount ranging from between 0.1–4.0 lb/ton to achieve FWA concentrations within the range of 1–20 ppm.

6 Claims, No Drawings

PROCESS OF MANUFACTURING AUTHENTICATABLE PAPER PRODUCTS

BACKGROUND OF INVENTION

The present invention relates generally to a method for producing authenticatable paper. More specifically, the present invention relates to a process for producing authenticatable paper and paperboard products by introducing into the papermaking furnish fibers to which there has been attached a fluorescent whitening agent (FWA) that is detectable using long wave UV illumination. Since FWA's are often used during the papermaking process to enhance the brightness of paper, it would be unlikely that a counterfeiter would recognize the use of an FWA in the paper as an authenticatable feature.

Traditionally, counterfeiting has been associated with the illicit production of currency. Today, however, there is a significant loss to manufacturers of goods by counterfeiting. This type of counterfeiting costs companies millions of dollars of lost revenue. For example, cigarette, pharmaceutical, computer software and related companies have experienced problems with counterfeited products being sold worldwide. Furthermore, these counterfeited products are usually made cheaply thereby causing an unsuspecting consumer to question the manufacturers' quality.

Thus it would be desirable, and in the best interest of a manufacturer to eliminate to the extent possible the sale of counterfeited products from an economic and public perception point of view. One way to accomplish this result is to provide packaging, labels and the like that can be authenticated for packaging the legitimate goods of a manufacturer.

Paper manufacturers have several different options at their disposal to authenticate paper products. These include the use of watermarks, specialized printing, holographic labels, and the use of synthetic or fluorescent fibers or additives. Thus packages which do not include these identifying features may be presumed to include counterfeited goods.

Watermarks consist of impressing a design into the wet fiber web prior to couching the paper. Since this process is done early in the papermaking process, it arranges some of the fibers within the paper. This arranging of the fibers makes watermarks difficult to duplicate.

Watermarks are used extensively in European and U.S. currencies and security documents. The security of the watermarking process may be enhanced with the controlled deposition of fibers during the paper forming process and the placing of individual, unique watermarks on each piece of paper.

The use of watermarks is ideally suited to the manufacture of thin papers such as currencies, bank checks, etc., which are substantially translucent. However, the use of watermarks on heavy weight paper or paperboard normally used for packaging or labels is of less utility because of the low transmission of light through such products. A watermark on these thicker papers would not be readily apparent as in thinner, more translucent papers.

Complicated printing techniques have also been used as security devices for currencies. These are typically lifelike portraits and intricate designs. Additionally, specialty inks, blended exclusively for these end uses, have found extensive use in the security document sector. These specialty inks include everything from using multiple colors, to the use of high intensity ultraviolet light to create a pattern fluorescing in visible or ultraviolet light. However, the advent of high quality, color photocopiers has made the use of special inks and intricate designs less of a barrier to the counterfeiter.

In response to the increased ingenuity of counterfeiters, microprinting was developed. Microprinting is a technique where messages, etc., are finely printed on a paper substrate. To the naked eye, the printing appears to be a single line, but under magnification, the messages may be revealed. This technique makes duplication of the paper substrate more troublesome because the printing technique is difficult to reproduce. However, a drawback to the microprinting technique is that it is relatively easy to acquire a printing press. Also, one can set up this printing equipment anywhere and keep it well hidden.

Holographic labels are also used as an anti-counterfeit device. These labels have an image impressed into them which changes appearance dependent on the point of view. A familiar example of these labels is the shiny image on credit cards. While these are effective as an anti-counterfeit device, they are expensive to produce and keep track of.

Placing dyed synthetic fibers into the paper substrate has been practiced for many years as an anti-counterfeit device. A common example is the paper used for U.S. currency which has blue and red synthetic fibers in it. Though effective, it has a significant drawback because it can only be used in specific applications.

Finally, it is also known to use fibers, pigments and the like in the structure of the paper products that can be identified using various techniques. For example, U.S. Pat. No. 1,938,543 teaches that detectable fibers which have been specially treated with a chemically sensitive substance can be incorporated into paper and, upon contacting such paper with a second chemical agent, the detectable fibers change color and become distinguishable. A disadvantage with this type of technique is that it is a destructive test. As illustrated in U.S. Pat. No. 2,208,653, authenticatable paper can also be made by including fibers of an organic ester of cellulose that have been treated with a tertiary amine. The treated fibers are invisible in the paper and become fluorescent under ultraviolet light. U.S. Pat. No. 2,379,443 discloses authenticatable paper made by the addition of a small percentage of cellulosic fibers that have been treated with hydrated ferric chloride which has been hydrolyzed to iron hydroxide. The treated fibers are capable of acquiring a deep blue color upon application to the paper of a potassium ferrocyanide solution, followed by an orthophosphoric acid solution.

Nevertheless, the authenticatable papers disclosed in the prior art generally have not proven entirely satisfactory because, for example, of their complexity of manufacture, or the fact that such papers before authentication often visibly differ from paper that does not include an authenticatable feature, or the procedure for testing is cumbersome.

It is apparent from the above that there exists a need in the art for an authenticatable paper or paperboard that is inexpensive to manufacture, effective in use, and hard to duplicate. Furthermore, the authenticatable materials used should not interfere with the print characteristics of the paper nor the coating operations. It is the purpose of this invention to fulfill these and other needs in the art in a manner more apparent to the skilled artisan once given the following disclosure.

SUMMARY OF THE INVENTION

In accordance with the present invention, paper and paperboard products may be made authenticatable by the addition of a small percentage of fluorescent fibers to the papermaking furnish. Such fibers when incorporated in a paper or paperboard substrate at a concentration of between about 0.1–4.0 lbs/ton may be detected under long wave ultraviolet (UV) radiation. The preferred fluorescent agent employed in the present invention is a standard fluorescent whitening agent (FWA) that is soluble in water. Discrete fibers when treated with an FWA display a strong blue fluorescence under long wave UV radiation.

The use of fluorescent whitening agents in the manufacture of paper is well known for the purpose of achieving a product having high whiteness and brightness as disclosed for example in U.S. Pat. Nos. 5,026,507 and 5,141,672, assigned to the present assignee. Thus the incorporation of an FWA in paper or paperboard products for authentication is not a technique that would be readily recognized by a potential counterfeiter. Likewise, the incorporation of the FWA treated fibers in the papermaking furnish has no impact whatsoever on the papermaking process including drying and coating. The treated fibers remain detectable whether the substrate is coated-one-side (C1S) or coated-two-sides (C2S).

It is, therefore, an object of the present invention to provide an easily authenticatable paper or paperboard product which is easy to manufacture and use.

It is another object of the present invention to provide an authenticatable paper or paperboard product that can be used for labels or packaging of products that are subject to counterfeiting.

Other objects and advantages of the present invention will become apparent from the following detailed description which sets forth several specific embodiments of the invention for the purpose of illustrating suitable modes for practicing the invention.

DETAILED DESCRIPTION

Papermaking fibers treated with from about 50–200 lbs/ton of a fluorescent whitening agent (FWA) can be added to, and detected in, conventional paper and paperboard products at concentrations ranging from about 0.1–4.0 lbs/ton. Under long wave UV illumination, these discrete treated fibers display a strong blue fluorescence. FWA's operate by emitting bluish light upon excitation in the long UV region of the spectrum (350–400 nm). This light serves to compensate for the yellowness inherent in paper products, and for the present invention, serves as a means for authenticating the origin of the paper products.

EXAMPLES

In an initial experiment, handsheet blotter stock was saturated with high concentrations of two fluorescent whitening agents (Leucophor T-110 a tetrasulfonated FWA, supplied by The Clariant Corporation, and Intrawite PWA also a tetrasulfonated FWA, supplied by The Crompton and Knowles Corporation). The blotters were soaked in 2.0% solids solutions and the pickups determined. After drying, the treated blotters were immersed in a 1.0% alum solution, pickups were determined and the blotters were heat dried. FWA pickups were 53.1 lbs/ton for the Leucophor T-110 brightener and 50.4 lbs/ton for Intrawite PWA. The treated fibers from the blotters were added separately to a standard mill refined furnish containing 85% hardwood and 15% softwood at either 0.1 or 1.0 lb/ton and handsheets were made for testing. In each case (i.e., for the Leucophor T-110 and Intrawite PWA), the treated fibers were easily discernable under a long wave UV lamp.

In a second experiment, 1000 grams of a never dried bleached softwood pulp furnish were mixed in a British disintegrator for 5 minutes. Exactly 50 lbs/ton of Leucophor T-110 were added to the furnish under low shear agitation and allowed to mix for 10 minutes. Alum was added to the mixture at the rate of 25 lbs/ton and allowed to mix for an additional 10 minutes. After filtering and washing, the treated fibers were incorporated in handsheets at concentrations of 0.1, 1.0 and 2.0 lbs/ton of a standard mill refined papermaking furnish substantially as described above. The individual treated fibers were readily discernable under a long wave UV lamp. Since FWA's have an affinity for chemical pulps, the use of an FWA as an authenticatable feature in bleached chemical furnishes is fairly straightforward.

In another experiment, dried refiner thermomechanical pulp (TMP) fibers were saturated with a 2.0% Leucophor T-110 solution, pickup was determined after drying and the treated fibers were soaked in a 1.0% alum solution to precipitate and retain the FWA on the TMP fibers. These treated fibers were incorporated in separate handsheets at concentrations of 0.1, and 1.0 and 2.0 lbs/ton of a standard papermaking furnish. Discrete treated fibers in the handsheets fluoresced blue under long wave UV illumination and were readily detectable. Since FWA's are not generally used in furnishes which contain high yield mechanical fibers such as TMP, the use of an FWA in paper or paperboard products made from such furnishes as an authenticatable feature would not likely be contemplated by a counterfeiter. Furthermore, where TMP treated fibers are present, a second security feature manifests itself because, when spot tested with phloroglucinol stain, the treated fibers in the handsheets turned red.

In a fourth experiment utilizing FWA treated refiner TMP fibers, the basic furnish for the handsheets was a 90% hardwood, 10% softwood pulp blend. For this experiment, exactly 0.2 and 2.0 lbs/ton of the treated fibers from the dried refiner TMP pulp of the previous experiment were incorporated in separate handsheets. These sheets were then coated on one side only (C1S), with a typical clay containing coating formulation using a laboratory handsheet coater. Coat weights averaged 10.9 lbs/ream (ream size 3000 $ft^2$). The treated fibers were easily detected through the coating layer since they fluoresced blue under long wave UV illumination. When spot tested with phloroglucinol stain applied to either the coated or uncoated side of the sheet, the treated fibers also turned red, as described above, providing the second security test.

In a final experiment, treated chemical fibers were incorporated in an unbleached fiber furnish at concentrations ranging from 1.0–4.0 lbs/ton. Bleached softwood fibers were mixed in a British disintegrator for 5 minutes at 1.0% consistency. Leucophor T-110 FWA was added to the fiber slurry equivalent to about 200 lbs/ton of dry fiber. The FWA was allowed to exhaust on the fiber for 15 minutes after which the equivalent of 25 lbs/ton alum (1.0% concentration) was added to precipitate any FWA not on the fiber. The equivalent of 1.0, 2.0, 3.0 and 4.0 lbs/ton of the treated fibers were added to separate unbleached furnishes. Sheets were formed and dried. The treated fibers could not be seen in daylight, but were readily detected under UV radiation. Fiber counts ranged from 900/$ft^2$ at 1.0 lb/ton concentration to 3250/$ft^2$ at 4.0 lbs/ton. Thus it may be seen that the present invention may be practiced with papermaking furnishes using bleached chemical pulp or with furnishes which contain unbleached chemical or high yield mechanical pulps such as TMP. Where an unbleached fiber furnish is used, higher concentrations of FWA are necessary to achieve the desired results because of the presence of lignin on the unbleached fibers. Lignin is a UV absorber, therefore treated fibers located beneath the surface may not be detectable under UV illumination.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. The process of manufacturing and testing authenticatable paper comprising:

(a) treating a slurry of papermaking fibers selected from the group consisting of bleached chemical pulp and high yield lignin containing mechanical pulp with from 50–200 lbs/ton of a water soluble fluorescent whitening agent so as to cause said fluorescent whitening agent to become attached to said fibers;

(b) mixing the treated fibers of step (a) with a bleached chemical papermaking furnish to achieve a concentration of treated fibers in the furnish of about 0.1–4.0 lbs/ton of the furnish;

(c) producing a paper product from the papermaking furnish of step (b); and, (d) exposing the paper product of step (c) to long wave ultraviolet illumination to detect the presence of the individual treated fibers in the paper product wherein the individual treated fibers fluoresce blue.

2. The process of claim 1 wherein the treated fibers of step (a) comprise high yield lignin containing mechanical pulp wherein the treated fibers fluoresce blue under long wave ultraviolet illumination and turn red upon being spot tested with a pholoroglucinal stain to provide a second authenticatable feature.

3. The process of claim 1 including the step of applying a clay containing coating, between steps (c) and (d), to at least one side of the paper.

4. An authenticatable paper product prepared from a bleached chemical papermaking furnish wherein from about 0.1–14.0 lbs/ton of the furnish consists of papermaking fibers treated with from 50–200 lbs/ton of a water soluble fluorescent whitening agent so as to cause said fluorescent whitening agent to become attached to said fibers and achieve a concentration of the fluorescent whitening agent in the paper product of less than about 20 ppm, wherein said individual treated fibers are detectable under long wave ultraviolet illumination.

5. The paper product of claim 4 wherein the paper product has a clay containing coating on one side only.

6. The paper product of claim 4 wherein both sides of the paper include a clay containing coating.

* * * * *